US006340934B1

(12) United States Patent
Hisada

(10) Patent No.: US 6,340,934 B1
(45) Date of Patent: Jan. 22, 2002

(54) VEHICLE-RELEVANT ONBOARD ETC-INFORMATION COMMUNICATION CONTROL APPARATUS

(75) Inventor: Masaaki Hisada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/703,731

(22) Filed: Nov. 2, 2000

(30) Foreign Application Priority Data

Mar. 31, 2000 (JP) ..... 2000-097724

(51) Int. Cl.[7] ..... G08G 1/00; G08G 1/096

(52) U.S. Cl. ..... 340/928; 340/905; 235/382; 235/384; 701/117

(58) Field of Search ..... 340/928, 905, 340/933, 901, 539, 934, 936, 938; 701/117, 118, 119; 235/380, 382, 384

(56) References Cited

U.S. PATENT DOCUMENTS

| | | | | | |
|---|---|---|---|---|---|
| 5,424,727 | A | * | 6/1995 | Shieh | 340/928 |
| 5,451,758 | A | * | 9/1995 | Jesadanont | 235/384 |
| 5,663,548 | A | * | 9/1997 | Hayashi et al. | 235/384 |
| 5,675,494 | A | * | 10/1997 | Sakurai et al. | 705/417 |
| 5,705,996 | A | * | 1/1998 | Eguchi et al. | 340/928 |
| 5,710,702 | A | * | 1/1998 | Hayashi et al. | 340/928 |
| 5,805,082 | A | * | 9/1998 | Hassett | 340/928 |
| 5,955,970 | A | * | 9/1999 | Ando et al. | 340/928 |
| 5,969,641 | A | * | 10/1999 | Nakamura et al. | 340/928 |
| 6,040,785 | A | * | 3/2000 | Park et al. | 340/928 |
| 6,138,912 | A | * | 10/2000 | Mitsuno | 235/384 |

* cited by examiner

*Primary Examiner*—Daniel J. Wu
*Assistant Examiner*—Toan Pham
(74) *Attorney, Agent, or Firm*—Sughrue Mion, PLLC

(57) ABSTRACT

An ETC-relevant information communication control system designed for limiting ETC-relevant information communication between an ETC communication equipment of a toll gate provided on or along a toll road and an vehicle-onboard ETC-relevant information communication control apparatus of a motor vehicle after entry thereof into a communication area for a predetermined interval up to a location within the communication area where communication error can be evaded while maintaining the current speed of the motor vehicle entering the communication area. The vehicle-onboard ETC-relevant information communication control apparatus includes a communication limiting interval setting means (8A) for setting a communication limiting interval for disabling communication between a vehicle-onboard ETC-relevant information communication control apparatus and the ETC communication equipment of the toll gate until the motor vehicle entered a communication area where communication between the vehicle-onboard ETC-relevant information communication control apparatus and the ETC communication equipment is possible has traveled a predetermined distance within the communication area, a vehicle-traveled distance arithmetic means (8A; 15) for arithmetically determining a vehicle-traveled distance within the communication area as measured from a time point the motor vehicle entered the communication area, and a communication control means (8A) for making decision as to whether or not the vehicle-traveled distance as calculated by the travel distance arithmetic means (8A, 15) exceeds the distance equivalent to the vehicle-traveled distance preset by the communication limiting interval setting means (8A) to thereby allow the communication between the ETC communication equipment and the vehicle-onboard ETC-relevant information communication control apparatus to be started when decision is made that the vehicle-traveled distance exceeds the preset communication limiting interval.

5 Claims, 13 Drawing Sheets

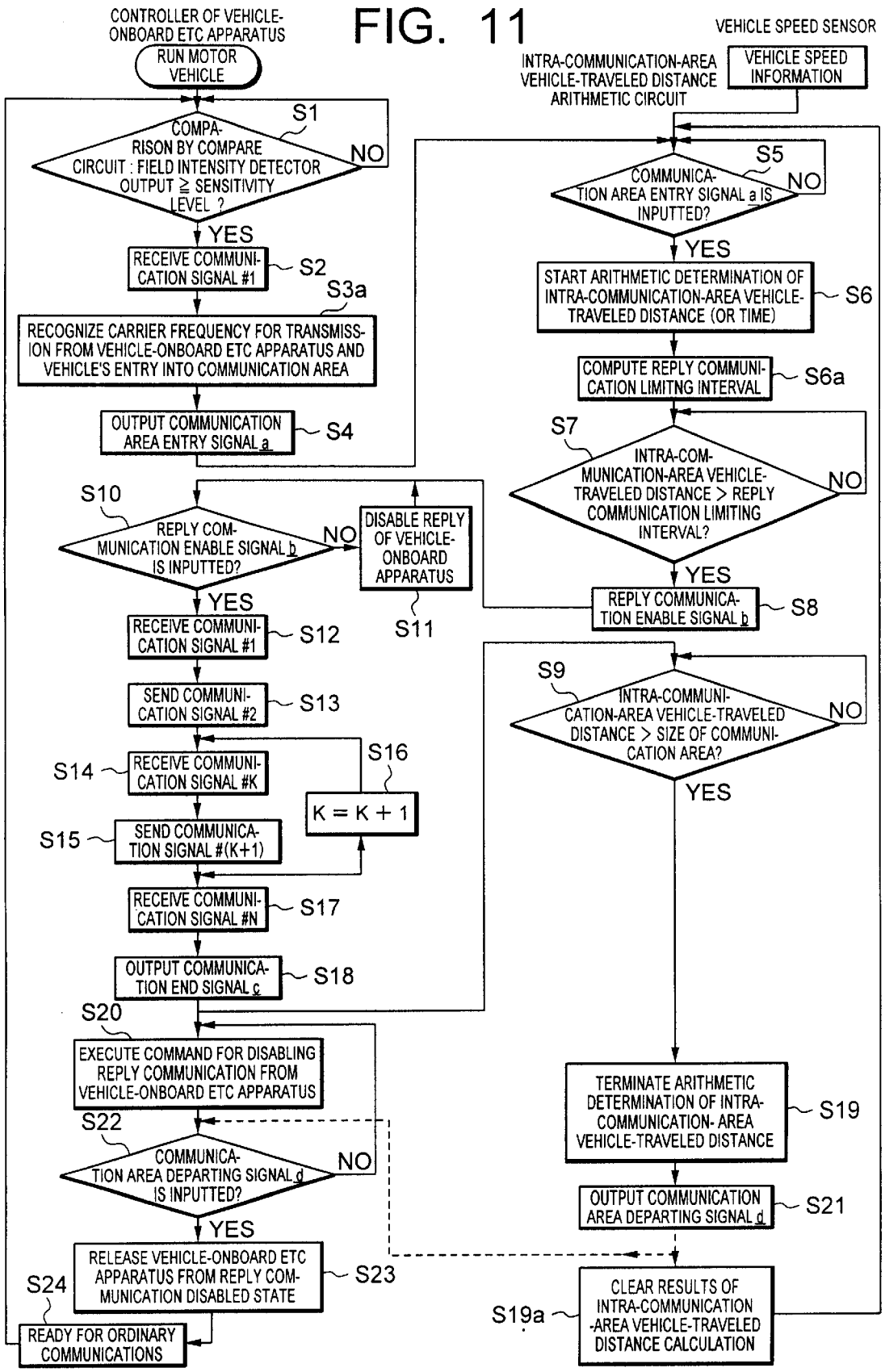
FIG. 11
CONTROLLER OF VEHICLE-ONBOARD ETC APPARATUS
RUN MOTOR VEHICLE
S1
COMPARISON BY COMPARE CIRCUIT : FIELD INTENSITY DETECTOR OUTPUT ≧ SENSITIVITY LEVEL ?
NO
YES
RECEIVE COMMUNICATION SIGNAL #1
S2
S3a
RECOGNIZE CARRIER FREQUENCY FOR TRANSMISSION FROM VEHICLE-ONBOARD ETC APPARATUS AND VEHICLE'S ENTRY INTO COMMUNICATION AREA
OUTPUT COMMUNICATION AREA ENTRY SIGNAL a
S4
S10
REPLY COMMUNICATION ENABLE SIGNAL b IS INPUTTED?
NO
DISABLE REPLY OF VEHICLE-ONBOARD APPARATUS
S11
YES
RECEIVE COMMUNICATION SIGNAL #1
S12
SEND COMMUNICATION SIGNAL #2
S13
S14
RECEIVE COMMUNICATION SIGNAL #K
S16
K = K + 1
S15
SEND COMMUNICATION SIGNAL #(K+1)
RECEIVE COMMUNICATION SIGNAL #N
S17
OUTPUT COMMUNICATION END SIGNAL c
S18
S20
EXECUTE COMMAND FOR DISABLING REPLY COMMUNICATION FROM VEHICLE-ONBOARD ETC APPARATUS
S22
COMMUNICATION AREA DEPARTING SIGNAL d IS INPUTTED?
NO
YES
RELEASE VEHICLE-ONBOARD ETC APPARATUS FROM REPLY COMMUNICATION DISABLED STATE
S23
S24
READY FOR ORDINARY COMMUNICATIONS
VEHICLE SPEED SENSOR
INTRA-COMMUNICATION-AREA VEHICLE-TRAVELED DISTANCE ARITHMETIC CIRCUIT
VEHICLE SPEED INFORMATION
S5
COMMUNICATION AREA ENTRY SIGNAL a IS INPUTTED?
NO
YES
START ARITHMETIC DETERMINATION OF INTRA-COMMUNICATION-AREA VEHICLE-TRAVELED DISTANCE (OR TIME)
S6
COMPUTE REPLY COMMUNICATION LIMITNG INTERVAL
S6a
S7
INTRA-COMMUNICATION-AREA VEHICLE-TRAVELED DISTANCE > REPLY COMMUNICATION LIMITING INTERVAL?
NO
YES
REPLY COMMUNICATION ENABLE SIGNAL b
S8
S9
INTRA-COMMUNICATION-AREA VEHICLE-TRAVELED DISTANCE > SIZE OF COMMUNICATION AREA?
NO
YES
TERMINATE ARITHMETIC DETERMINATION OF INTRA-COMMUNICATION- AREA VEHICLE-TRAVELED DISTANCE
S19
OUTPUT COMMUNICATION AREA DEPARTING SIGNAL d
S21
S19a
CLEAR RESULTS OF INTRA-COMMUNICATION -AREA VEHICLE-TRAVELED DISTANCE CALCULATION

VEHICLE-RELEVANT ONBOARD ETC-INFORMATION COMMUNICATION CONTROL APPARATUS

BACKGROUND OF THE INVENTION

1. Field of the Invention

The present invention relates generally to a communication control system for ETC (electronic toll collection)-relevant information. More particularly, the invention is concerned with an vehicle-onboard ETC-relevant information communication control apparatus (hereinafter also referred to simply as the vehicle-onboard ETC apparatus) which is mounted on a motor vehicle running on a toll road for exchanging or interchanging through radio wave communication the ETC-relevant information concerning the toll charge/payment and others with ETC communication facility or equipment installed at a toll gate by way of an overhead antenna which may also be termed a toll gate antenna and which is disposed stationarily over and across the toll road and an antenna mounted on a motor vehicle (hereinafter also referred to as the vehicle-mounted antenna) to thereby allow the toll charge/payment settlement processing to be performed on the basis of the ETC-relevant information in a cashless manner.

2. Description of Related Art

For having better understanding of the concept underlying the present invention, description will first be made of a conventional vehicle-onboard ETC-relevant information communication control apparatus known heretofore by reference to FIG. 12 which shows generally and schematically in a block diagram a structure of a hitherto known vehicle-onboard ETC-relevant information communication control apparatus (hereinafter also referred to simply as the vehicle-onboard ETC apparatus) employed in a conventional ETC (electronic toll control) system.

Referring to FIG. 12, the vehicle-onboard ETC apparatus shown in this figure is comprised of a receiving antenna 1R mounted on a motor vehicle for receiving communication signals indicative of toll charge/payment information from an overhead antenna of ETC communication equipment installed at a relevant toll gate station (not shown), a receiving or input amplifier 2 for receiving the communication signal through the medium of the receiving antenna 1R to thereby amplify the communication signal as received, a receiving mixer circuit (which may also be referred to as a down converter) 3 for mixing the received and amplified signal outputted from the input amplifier 2 with an oscillation signal outputted from a local oscillator 3*a* to thereby generate a communication signal of a frequency lower than that of the received signal, a data demodulator 4 for demodulating the communication signal outputted from the receiving mixer circuit 3 for the purpose of information processing, an electric field intensity detector (hereinafter also referred to simply as the field intensity detector) 5 for detecting the intensity level of the communication signal outputted from the receiving mixer circuit 3 as the electric field intensity level prevailing upon reception of the toll charge/payment-relevant information, a comparator 6 designed for comparing the detected field intensity level with an electric field intensity level set in advance by a controller incorporated in the vehicle-onboard ETC apparatus (which field intensity level will hereinafter be referred to as the preset field intensity or preset field intensity level) to thereby generate as the output an electric field intensity confirmation or discrimination signal when the detected field intensity level is higher than that of the preset field intensity, and a logical product circuit (logical AND circuit) 7 for supplying the communication signal outputted from the data demodulator 4 to the controller 8 of the vehicle-onboard ETC apparatus as the received data when the field intensity discrimination signal mentioned above is outputted from the comparator 6.

Further, the vehicle-onboard ETC-relevant information communication control apparatus is comprised of a low-pass filter 9 for performing a filter processing on data signal to be sent or transmitted to the ETC communication equipment of the toll gate as the communication signal from the controller 8 of the vehicle-onboard ETC apparatus after eliminating high harmonic components, a transmission modulator 10 for modulating a carrier signal outputted from a local oscillator 3*a* with the transmission signal (i.e., signal for transmission) outputted from the low-pass filter 9, a transmission amplifier 11 for amplifying the modulated transmission data signal outputted from the transmission modulator 10, and a transmitting antenna 1T for sending or transmitting the amplified data signal outputted for transmission from the transmission amplifier 11 to the ETC communication equipment of the toll gate as a communication signal.

In addition, the vehicle-onboard ETC-relevant information communication control apparatus includes a display device 12 for displaying as images the toll charge/payment information and others exchanged or interchanged with the ETC communication equipment installed at the toll gate, an external interface 13 for outputting the toll charge/payment information interchanged with the ETC communication equipment of the toll gate to external equipment of concern (not shown), and an external storage 14 for recording or storing varieties of control information written and to be read by the controller 8 of the vehicle-onboard ETC apparatus.

Now, referring to FIG. 13 showing a communication sequence diagram, description will be directed to operations of the conventional vehicle-onboard ETC-relevant information communication control apparatus implemented in the structure described above.

In the conventional vehicle-onboard ETC-relevant information communication control apparatus or ETC apparatus, the communication signal sent from the ETC communication equipment of a toll gate by way of the overhead antenna thereof (not shown in FIG. 13) is received firstly by the receiving antenna 1R mounted on the motor vehicle to be subsequently amplified by the input amplifier 2, the output of which is then inputted to the receiving mixer circuit 3. The mixer circuit 3 then converts the frequency of the communication signal inputted thereto to a lower frequency (down converting) as mentioned previously. From the output of the receiving mixer circuit 3, the original data before being modulated in the ETC communication equipment of the toll gate is restored through demodulation by means of the data demodulator 4. Further, the field intensity level of the received signal outputted from the mixer circuit 3 is detected by means of the field intensity detector 5. The detected electric field intensity level is compared with the receiving sensitivity discrimination reference level preset by the controller 8 of the vehicle-onboard ETC apparatus by means of the comparator 6. When it is decided by the comparator circuit 6 that the electric field intensity level is higher than the receiving sensitivity discrimination reference level inclusive thereof, then the field intensity discrimination signal is outputted from the comparator circuit 6 to be subsequently supplied to the controller 8 incorporated in the vehicle-onboard ETC apparatus.

Besides, at this time point, the demodulated data outputted from the data demodulator 4 is inputted to the logical product (AND) circuit 7 together with the field intensity discrimination signal. Consequently, so far as the electric field intensity level of the received communication signal is not lower than the receiving sensitivity discrimination reference level preset by the controller 8 of the vehicle-onboard ETC apparatus and thus when the electric field intensity discrimination signal is outputted, the received signal undergone the demodulation is outputted as the received data from the logical product (AND) circuit 7 to be supplied to the controller 8 of the vehicle-onboard ETC apparatus. In response to the input of the field intensity discrimination signal, the controller 8 of the vehicle-onboard ETC apparatus can decide or recognize that the motor vehicle has entered a communication area where radio-wave communication can be carried out between the vehicle-onboard ETC-relevant information communication control apparatus and the ETC communication equipment of the toll gate.

Upon recognition of the entry of the motor vehicle into the communication area by the controller 8 of the vehicle-onboard ETC apparatus, the latter receives a communication signal #1 sent from the ETC information communication equipment of the toll gate, whereupon the controller 8 of the vehicle-onboard ETC apparatus recognizes or determines the carrier frequency for transmission (i.e., transmission frequency) of relevant data from the vehicle-onboard ETC apparatus to the ETC communication equipment. In dependence on the result of the recognition mentioned above, processing of the communication signal #1 is executed. As a result of this processing, the controller 8 of the vehicle-onboard ETC apparatus outputs the transmission data (i.e., data for transmission) to the low-pass filter 9, whereby the carrier signal outputted from the local oscillator 3*a* is modulated with the transmission data (i.e., data for transmission) by means of the transmission modulator 10. The output signal of the transmission modulator 10 is then amplified by the output amplifier 11 to be subsequently transmitted to the ETC information communication equipment of the toll gate in terms of a communication signal #2 from the transmitting antenna 1T by way of the overhead antenna. In this manner, return or reply communication is started on the side of the vehicle-onboard ETC apparatus (i.e., vehicle-onboard ETC-relevant information communication control apparatus). In succession, exchange or interchange of the communication signals concerning settlement of the ETC charge/payment transaction is performed between the vehicle-onboard ETC apparatus and the ETC communication equipment of the toll gate for a plurality of times (N times) in accordance with the communication protocol established for processing for settlement of the toll charge/payment transaction, whereupon the communication for the toll charge/payment processing between the ETC communication equipment of the toll gate station and the vehicle-onboard ETC apparatus comes to an end.

In the conventional vehicle-onboard ETC-relevant information communication control apparatus or the vehicle-onboard ETC apparatus such as described above, whenever the ETC communication signal of a level not lower than the signal receiving sensitivity of the vehicle-onboard ETC apparatus is received from the ETC communication equipment of the toll gate, the signal carrying the information which complies to the reply request issued by the ETC communication equipment of the toll gate is sent back to the latter regardless of whether or not the vehicle-onboard ETC apparatus is located internally or externally of the communication area and regardless of the environmental conditions for communication.

However, when such situation arises that after the motor vehicle entered a communication-instable area, a lot of time has been taken for the motor vehicle to pass through the communication-instable area due to traffic jam or for any other reasons, error may occur in the reciprocative communication between the ETC communication equipment of the toll gate and the vehicle-onboard ETC apparatus. For coping with such communication error, communication restoring operation (or so-called communication error recovery operation) is performed for a predetermined number of times in an attempt for restoring the communication (i.e., reestablishing the communication path). This operation is also referred to as the retrial operation or simply as the retrial. However, unless the communication is established in the course of such retrial operation, then it is decided that the communication is impossible between the ETC communication equipment installed at the toll gate and the vehicle-onboard ETC apparatus, which thus results in that the communication is ultimately stopped or interrupted, to a disadvantage.

It has empirically been established that the conventional vehicle-onboard ETC-relevant information communication control apparatus (i.e., vehicle-onboard ETC communication apparatus) suffers a problem that the communication error such as mentioned above takes place very frequently in communication-instable areas A and B due to change or variation of the electric field intensity, as is illustrated in FIG. 2. The frequency of occurrence of such communication error increases in the case where a plurality of motor vehicles are forced to run with a short inter-vehicle distance or when the vehicle is forced to run at a low speed or when the motor vehicle is forced to stop or park within the communication-instable area A or B primarily due to the traffic jam. In that case, communication restoring operation is carried out a predetermined number of times in an attempt to restore the normal communication state, as described above. However, when the predetermined number of times preset for the communication restoring retrial operation has been exceeded while failing to restore the normal reciprocative communication between the vehicle-onboard ETC communication apparatus and the ETC communication equipment of the toll gate, it is then decided that the ETC transaction communication is impossible, being accompanied with interruption of the communication between the vehicle-onboard ETC apparatus and the ETC communication equipment installed at the toll gate. Thereafter, any further communication is disabled between the vehicle-onboard ETC apparatus and the ETC control system at any one of the succeeding toll gate stations, to a great disadvantage.

SUMMARY OF THE INVENTION

In the light of the state of the art described above, it is an object of the present invention to solve the problems of the conventional ETC control system which is comprised of the vehicle-onboard ETC-relevant information communication control apparatus and ETC communication equipment installed at toll gates of a toll road as described above and to provide an ETC control system of an improved structure which is capable of restricting or limiting the communication between the vehicle-onboard ETC apparatus and the ETC communication equipment of the toll gate during a predetermined time interval until the motor vehicle which entered a communication area has reached a location within the communication area at a current traveling speed where the communication error such as mentioned previously can be avoided.

In view of the above and other objects which will become apparent as the description proceeds, there is provided according to a general aspect of the present invention an vehicle-onboard ETC-relevant information communication control apparatus mounted on a motor vehicle capable of running on and along a toll road for interchanging information required at least for toll charge/payment transaction with ETC communication equipment of a toll gate installed in association with the toll road to thereby execute toll charge/payment transaction processing on the basis of the ETC-relevant information mentioned above. The vehicle-onboard ETC-relevant information communication control apparatus includes a communication limiting interval setting means for setting a communication limiting interval for disabling function of the vehicle-onboard ETC-relevant information communication control apparatus for conducting communication with the ETC communication equipment of the toll gate until the motor vehicle entered a communication area where communication between the vehicle-onboard ETC-relevant information communication control apparatus and the ETC communication equipment of the toll gate is allowed has traveled for a predetermined distance within the communication area after entry thereto, a vehicle-traveled distance arithmetic means for arithmetically determining a vehicle-traveled distance for which the motor vehicle has traveled within the communication area from a time point when the motor vehicle entered the communication area, and a communication control means for making decision as to whether or not the vehicle-traveled distance arithmetically determined by the vehicle-traveled distance arithmetic means exceeds the communication limiting interval preset by the communication limiting interval setting means, to thereby allow communication between the vehicle-onboard ETC-relevant information communication control apparatus and the ETC communication equipment of the toll gate to be started when the decision is made to such effect that the vehicle-traveled distance has exceeded the communication limiting interval.

In a preferred mode for carrying out the invention, the communication limiting interval setting means may further be so designed as to set the communication limiting interval relatively short when running speed of the motor vehicle is relatively high, while setting the communication limiting interval relatively long when the running speed of the motor vehicle is relatively low.

In another preferred mode for carrying out the invention, the communication limiting interval setting means may be so designed as to set the communication limiting interval by extending in dependence on a traveling speed of the motor vehicle a time period lapsing from a time point when the motor vehicle entered the communication area to a time point at which the ETC-relevant information communication is to be started.

In yet another preferred mode for carrying out the invention, the communication limiting interval setting means may further be so designed as to set the communication limiting interval for disabling communication between the vehicle-onboard ETC-relevant information communication control apparatus and the ETC communication equipment, which interval extends from termination of the communication concerning the toll charge/payment transaction between the ETC communication equipment and the vehicle-onboard ETC-relevant information communication control apparatus to a time point at which any signal can no more be received from the ETC communication equipment for which the communication with the vehicle-onboard ETC-relevant information communication control apparatus has been terminated within the relevant communication area.

By virtue of the structures of the vehicle-onboard ETC-relevant information communication control apparatus according to the present invention which is so arranged as to effectuate the communication limitation after reception of an ETC communication signal, incapability of communication between the ETC communication equipment of a toll gate and the vehicle-onboard ETC apparatus which may be brought about by variation of the electric field intensity occurring under influence of third lobe of an overhead antenna of the ETC communication equipment and reflected radio waves from adjacent motor vehicles can be avoided regardless of temporary stopping of the motor vehicle, running speed thereof and presence of the adjacent motor vehicles, to a great advantage.

Furthermore, with the vehicle-onboard ETC-relevant information communication control apparatus provided by the present invention, the entry of the motor vehicle into the communication area is recognized or confirmed after reception of the communication signal emitted from the overhead antenna of the ETC communication equipment of the toll gate. By virtue of this feature, erroneous recognition of the vehicle position within the communication area due to erroneous recognition of the electric field intensity level as well as erroneous detection thereof can be evaded, whereby it is made possible to impose the communication restriction to the vehicle-onboard ETC apparatus up to a desired position or location within the communication area to thereby realize the ETC-relevant communication between the vehicle-onboard ETC apparatus and the ETC communication equipment installed at the toll gate in an ideal state, to another advantage.

Further, according to the present invention, the distance of the vehicle-onboard ETC apparatus from the overhead antenna of the ETC communication equipment can be recognized or detected with high reliability and accuracy, which can contribute in turn to enhancement of the capability of the vehicle-onboard ETC apparatus for performing communication of the ETC-relevant information with the ETC information communication equipment of the ETC control system, to yet another advantageous effect.

Furthermore, with the vehicle-onboard ETC apparatus according to the present invention, the reply communication limiting interval or period can be changed as a function of the vehicle speed. Owing to this feature, sufficient communication-allowable time period can be ensured regardless of the vehicle speed.

Besides, owing to the feature of the present invention that the communication between the ETC communication equipment of the toll gate and the vehicle-onboard communication apparatus can be interrupted up to a predetermined location after termination of the communication between the vehicle-onboard ETC apparatus and the ETC communication equipment within the communication area. Owing to this feature, even in such traffic situation where a plurality of ETC communication facilities inclusive of the overhead antennas, respectively, are installed in succession on one and the same road or lane in a same direction, the communication disturbance to the succeeding toll gate ETC communication equipment inclusive of the overhead antenna under the influence of the data remaining even after the termination of the communication between the vehicle-onboard ETC apparatus and the preceding ETC communication equipment inclusive of the overhead antenna thereof can be avoided in a satisfactory manner.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 11 is a flow chart for illustrating operation of the vehicle-onboard ETC-relevant information communication control apparatus according to the fourth embodiment of the invention;

DESCRIPTION OF THE PREFERRED EMBODIMENTS

Figure 1:
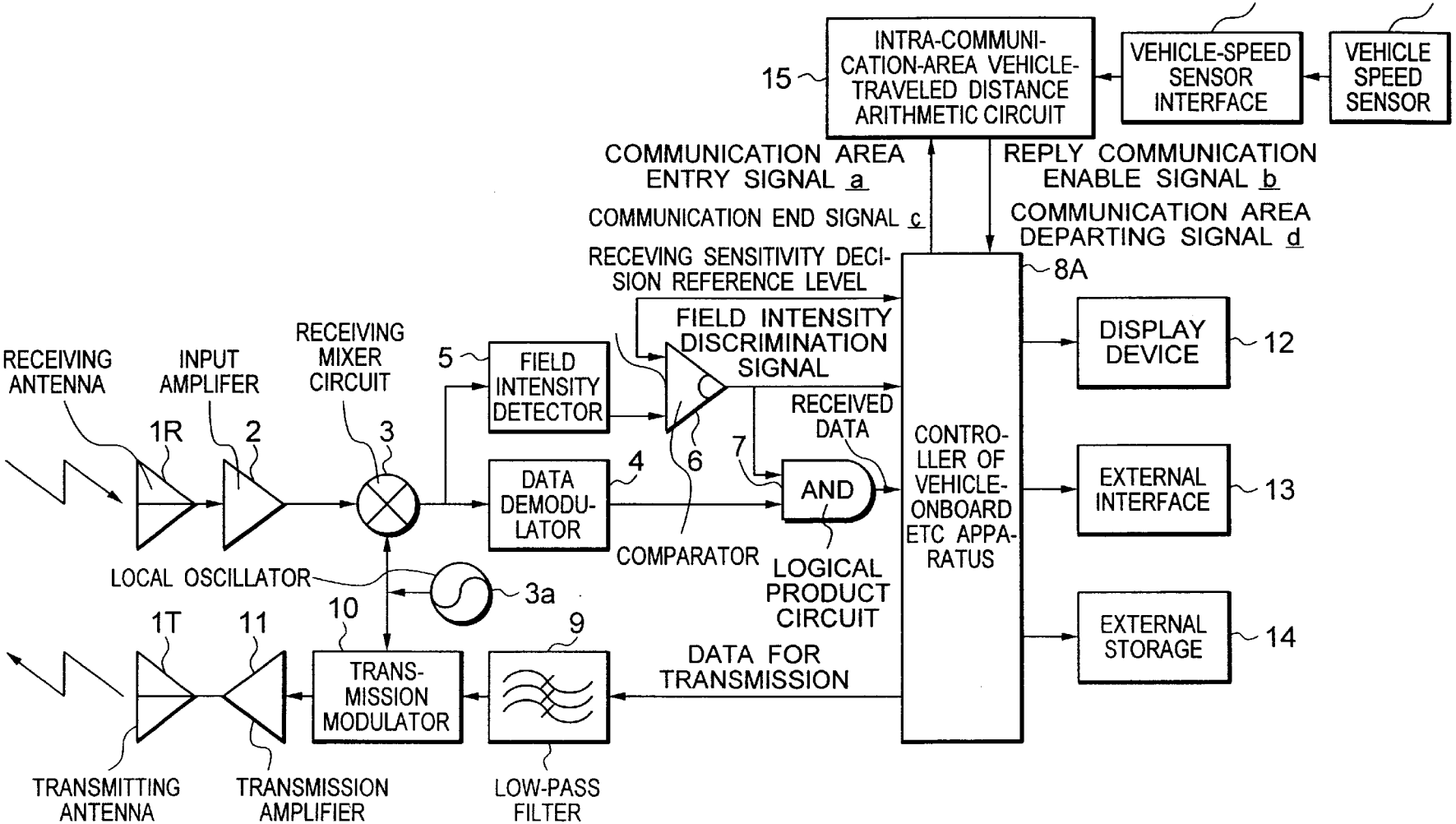
FIG. 1 is a block diagram showing schematically and generally a configuration of a vehicle-onboard ETC-relevant information communication control apparatus according to an embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

A first embodiment of the vehicle-onboard ETC-relevant information communication control apparatus according to the present invention will now be described.

Figure 12:
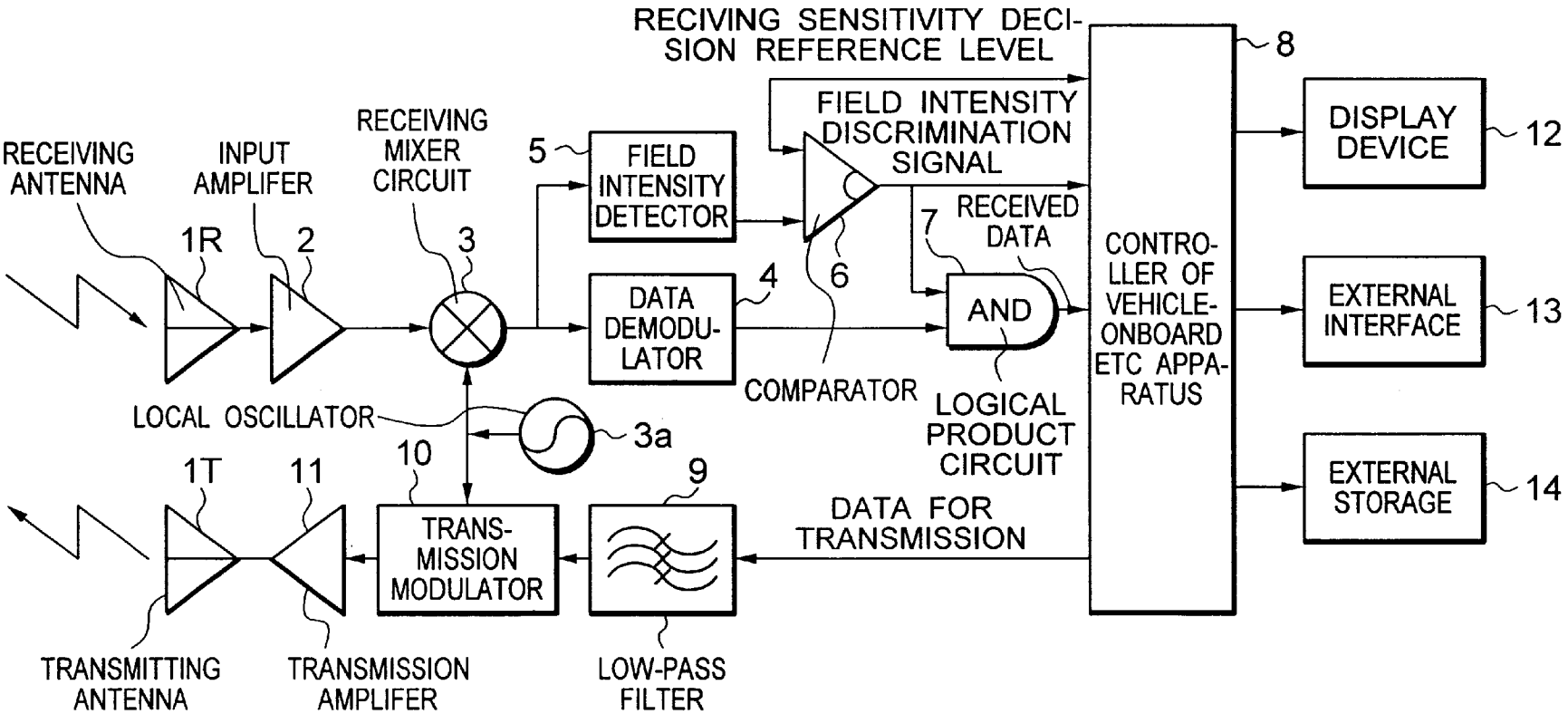
FIG. 12 is a block diagram showing schematically and generally a configuration of a conventional vehicle-onboard ETC-relevant information communication control apparatus known heretofore.
Figure 13:
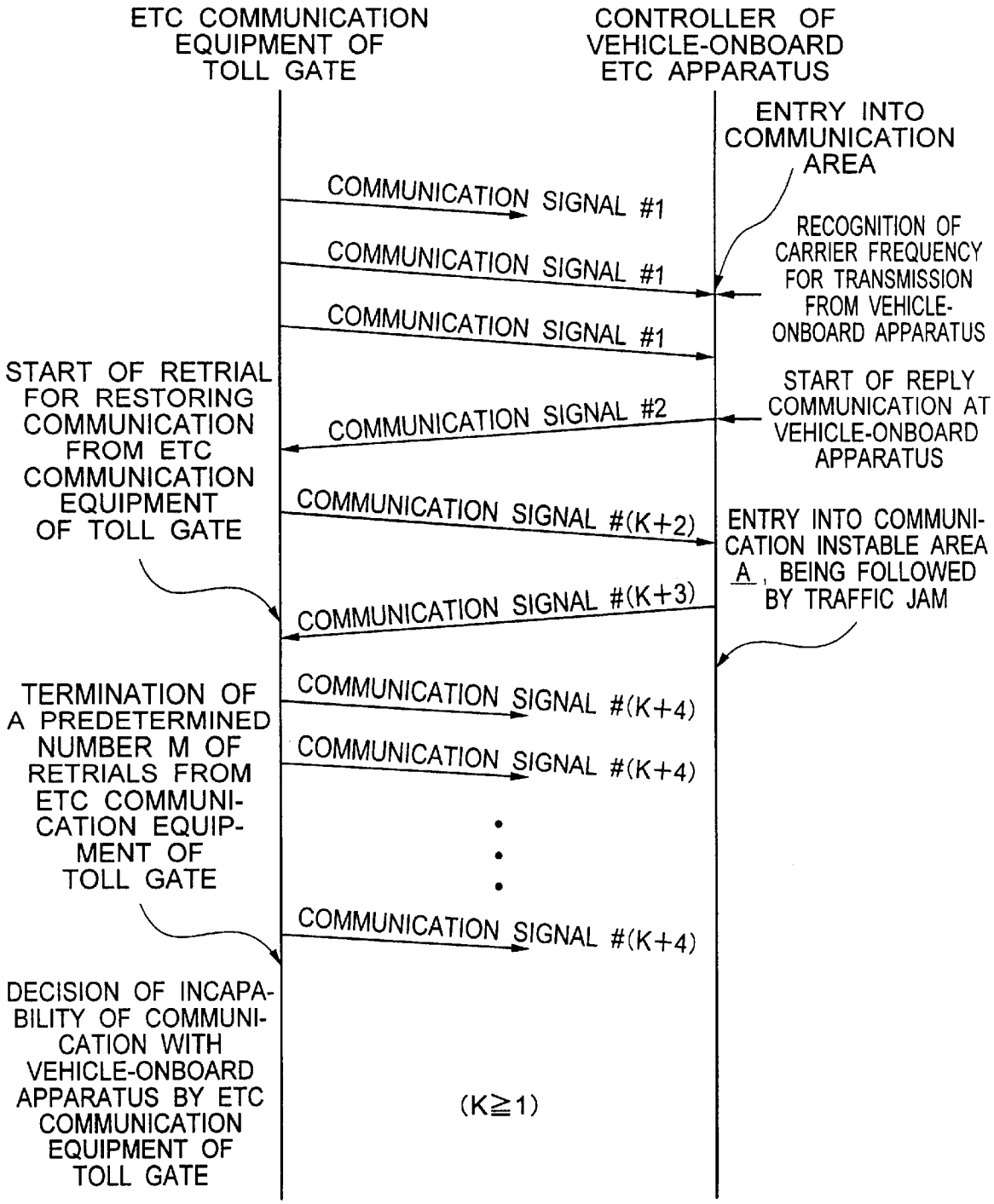
FIG. 13 is a communication sequence diagram for illustrating operations of the conventional vehicle-onboard ETC-relevant information communication control apparatus.

FIG. 1 is a block diagram showing a configuration of the vehicle-onboard ETC-relevant information communication control apparatus (or ETC system in short) according to a first embodiment of the present invention. In the figure, like reference symbols as those used in FIG. 12 denote parts or components which are same as or equivalent to those described hereinbefore in conjunction with the conventional vehicle-onboard ETC apparatus by reference to FIG. 12.

A controller BA of the vehicle-onboard ETC apparatus according to the first embodiment of the invention is imparted with a function for recognizing or detecting that the motor vehicle equipped with the vehicle-onboard ETC apparatus now concerned has entered the communication area on the basis of the field intensity discrimination signal or the received/demodulated signal as in the case of the conventional vehicle-onboard ETC-relevant information communication control apparatus described hereinbefore. In addition, the controller 8A of the vehicle-onboard ETC apparatus according to the instant embodiment of the invention has a function for outputting a communication area entry signal a (indicating that a concerned motor vehicle equipped with the vehicle-onboard ETC apparatus just entered the communication area) to an intra-area vehicle-traveled distance arithmetic circuit 15 upon recognition that the motor vehicle has just entered the communication area. In this conjunction, it is to be mentioned that the intra-area vehicle-traveled distance arithmetic circuit 15 is so designed as to arithmetically determine the distance the motor vehicle has traveled within the communication area after entry thereto on the basis of the communication area entering signal a as well as the vehicle speed information derived from the output of a vehicle speed sensor 17 and inputted through a vehicle-speed sensor interface 16, to thereby generate a reply communication enable signal b to the controller 8A of the vehicle-onboard ETC apparatus when the motor vehicle has traveled over a predetermined distance since the time point the motor vehicle entered the communication area.

Figure 2:
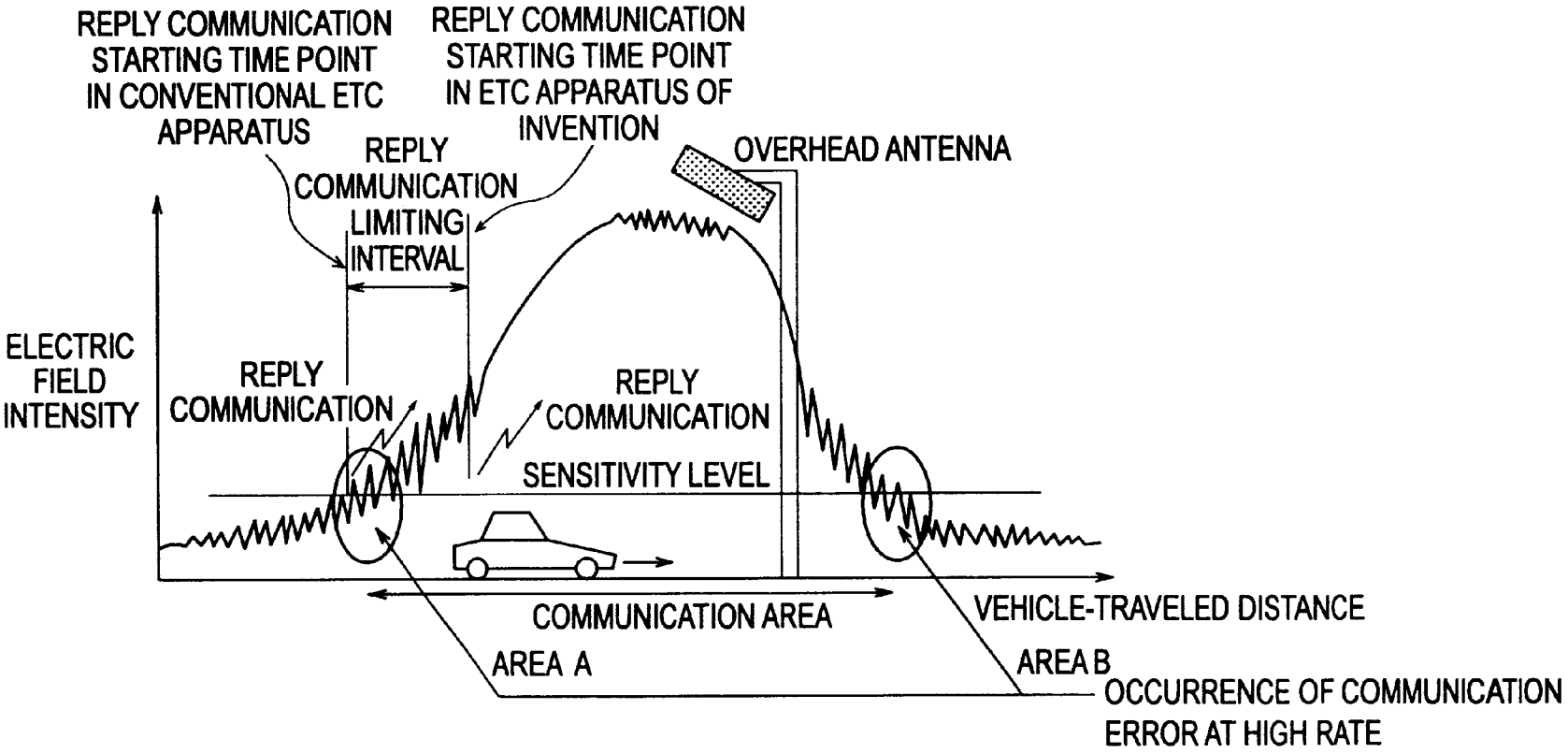
FIG. 2 is a signal reception field intensity distribution diagram for illustrating operations of the vehicle-onboard ETC-relevant information communication control apparatus according to first and second embodiments, respectively, of the present invention.
Figure 5:
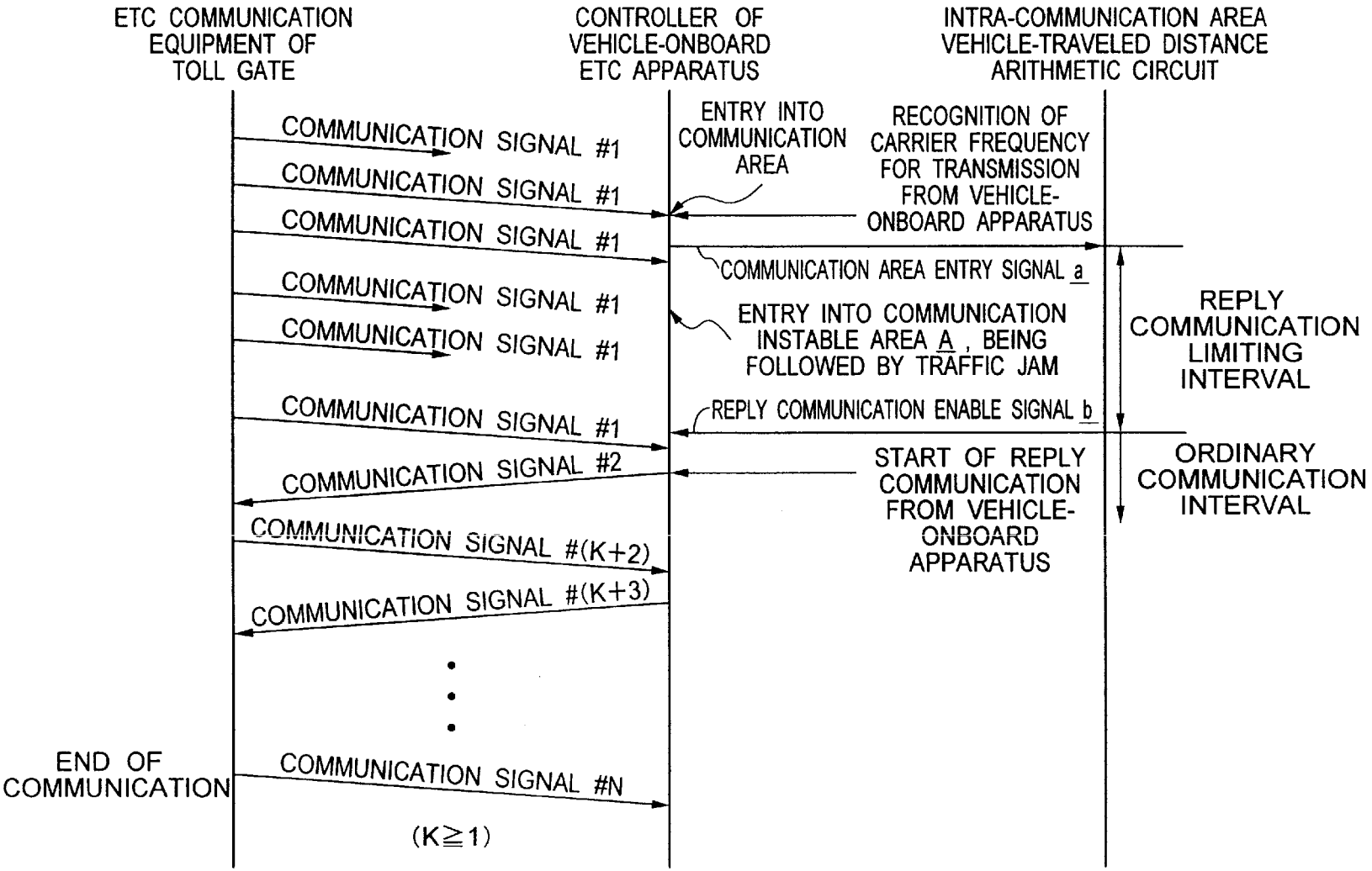
FIG. 5 is a communication sequence chart for illustrating operations of the vehicle-onboard ETC-relevant information communication control apparatus according to the first and second embodiments, respectively, of the invention.
Figure 8:
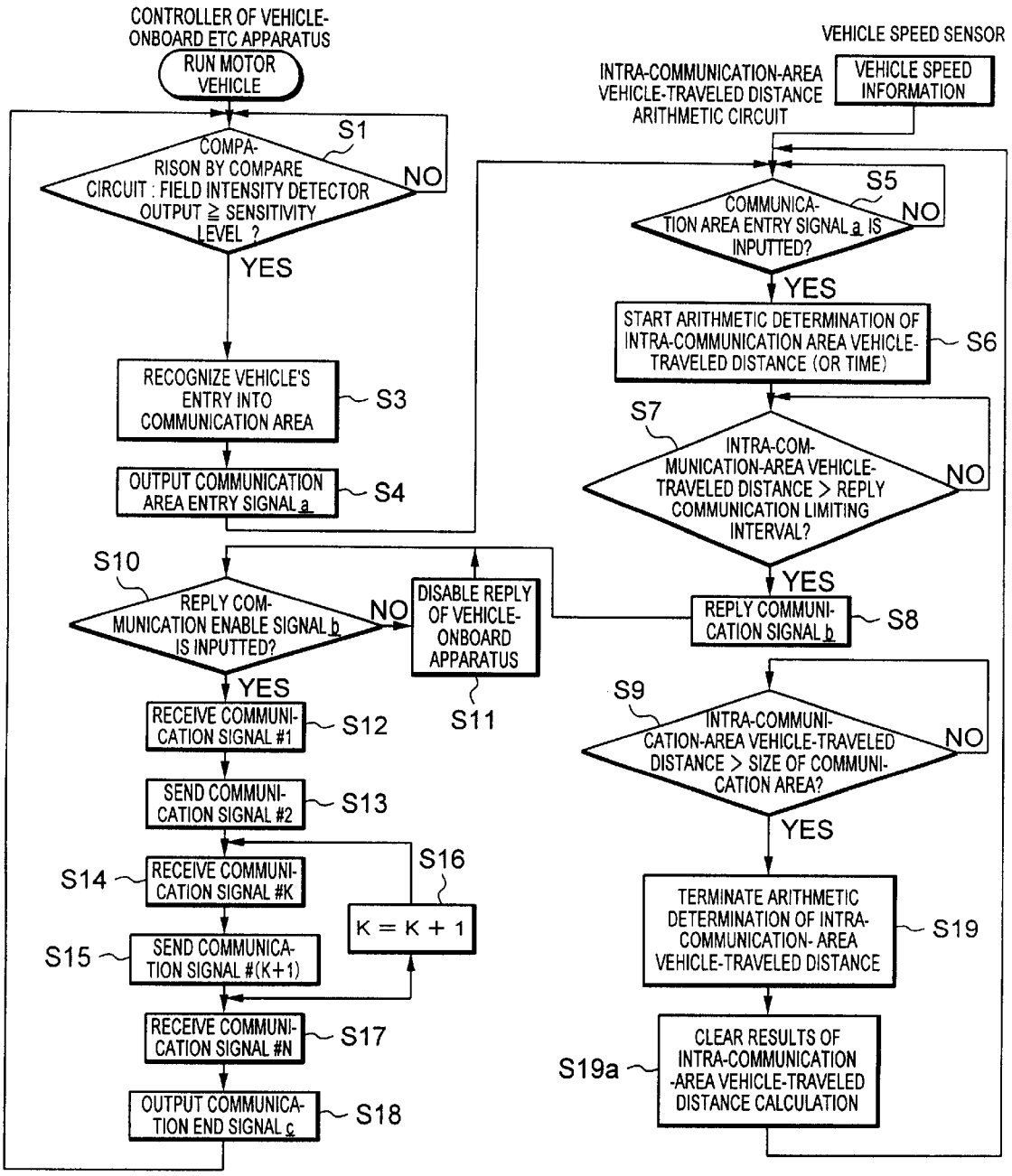
FIG. 8 is a flow chart for illustrating operation of the vehicle-onboard ETC-relevant information communication control apparatus according to the first embodiment of the present invention.

Next, operation of the vehicle-onboard ETC-relevant information communication control apparatus according to the first embodiment of the invention will be described by reference to FIG. 2 together with FIG. 5 and FIG. 6, in which FIG. 2 is a view for illustrating a distribution of the electric field intensity for reception of ETC-relevant information (also referred to as the reception field intensity) around an overhead antenna of the ETC communication equipment installed at a toll gate, FIG. 5 is a chart for illustrating a sequence of communication between a vehicle-onboard ETC apparatus and an ETC communication equipment of a toll gate according to the first embodiment of the invention and FIG. 8 is a flow chart for illustrating operation of the vehicle-onboard ETC apparatus according to the first embodiment of the invention.

As can be seen in FIG. 2, the electric field intensity level for reception of the toll charge/payment information sent from the ETC communication equipment of the toll gate is highest at a place located immediately beneath the overhead antenna of the toll gate station and becomes gradually lower as the distance from the overhead antenna increases.

Ultimately, the reception field intensity level becomes lower than the receiving sensitivity discrimination reference level (hereinafter also referred to simply as the sensitivity level) at which the communication area can discriminatively be determined by the vehicle-onboard ETC apparatus.

When the reception field intensity exceeds the sensitivity level, it is then decided by the vehicle-onboard ETC apparatus that the associated motor vehicle has entered the communication area. On the other hand, when the reception field intensity becomes lower than the sensitivity level, it is then decided that the motor vehicle has passed through the communication area and leaving that area.

At this juncture, it should again be mentioned that there exist communication-instable areas such as the area in the vicinity of the location where the motor vehicle enters the communication area (hereinafter this location will be referred to as the communication area entry location) and the communication-instable area in the vicinity of a location where the motor vehicle leaves the communication area. In each of these communication-instable areas, the reception field intensity assumes repetitively relatively higher level and relatively lower level than the sensitivity level at a relatively high repetition rate.

Consequently, assuming, by way of example, that a given motor vehicle entered the communication-instable area A at a low speed, instable state of the communication may prevail at the time point when the vehicle-onboard ETC apparatus of the given motor vehicle starts the reply communication in response to the communication signal #1 sent from the ETC communication equipment of the toll gate and receives the communication signal #n from the latter for interchanging the toll charge/payment information. When the communication instability state occurs, the ETC communication equipment installed at the toll gate performs retrial operation for sending repetitively the communication signal #n a predetermined number of times in an attempt to establish a path for communication with the vehicle-onboard ETC apparatus of the given motor vehicle. When such retrial operation has been repeated a predetermined number of times, decision is then made by the ETC communication equipment installed at the toll gate station that the vehicle-onboard ETC apparatus of the given motor vehicle is used illegally. Once the unauthorized or illegal use of the vehicle-onboard ETC apparatus has been decided, then the ETC communication equipment does not accept any further radio wave communication from the ETC apparatus of the given motor vehicle, rendering the latter to be incapable of performing any more communication with any toll gate equipment of the ETC control system, to a great disadvantage.

Such being the circumstances, the vehicle-onboard ETC-relevant information communication control apparatus according to the instant embodiment of the invention is so arranged that when such events as the mutually close running of plural motor vehicles (i.e., running of a plurality of motor vehicles with short inter-vehicle distance), low-speed running, transient stoppage or parking in the communication-instable area occurs due to the traffic jam or for other reasons, the reply communication is initiated at a time point when the motor vehicle has traveled a predetermined distance within the communication area after the vehicle entered the communication area, as is illustrated in FIG. 2. The time point mentioned above will also be referred to as the reply communication starting time point. In this conjunction, the predetermined distance mentioned above will also be referred to as the reply communication limiting time interval.

Next, operation of the vehicle-onboard ETC-relevant information communication control apparatus according to the instant embodiment of the invention will be described in detail by reference to the flow chart shown in FIG. 8. In the first place, the level of the field intensity outputted from the field intensity detector 5 is compared with the preset sensitivity level by means of the comparator 6 (step S1). When the output level of the field intensity detector exceeds the sensitivity level, the comparator 6 outputs the field intensity discrimination signal, which signal is then supplied to the controller 8A of the vehicle-onboard ETC apparatus. Thus, the entry of the motor vehicle into the communication area is ascertained or recognized (step S3).

When the entry of the motor vehicle into the communication area is recognized in this manner, the communication area entering signal a indicative of recognition of the entry of the motor vehicle into the communication area is supplied to the intra-area vehicle-traveled distance arithmetic circuit 15 (step S4).

Upon reception of the vehicle speed information from the vehicle speed sensor 17, the intra-area vehicle-traveled distance arithmetic circuit 15 makes decision as to whether or not the communication area entering signal a has been inputted (step S5). When the communication area entering signal a is decided as having been inputted (i.e., when the decision step S5 results in "YES"), the intra-area vehicle-traveled distance arithmetic circuit 15 arithmetically determines on the basis of the vehicle speed information the intra-communication-area vehicle-traveled distance (or time taken therefor), i.e., the distance or time for which the motor vehicle has traveled within the communication area after entry thereto which is indicated by the time point which the communication area entering signal a was inputted. Subsequently, the intra-area vehicle-traveled distance arithmetic circuit 15 makes decision as to whether or not the intra-communication-area vehicle-traveled distance (or the time taken therefor) as determined arithmetically is longer than the reply communication limiting interval set in advance on the basis of the vehicle speed (step S7). When it is decided that the intra-communication-area vehicle-traveled distance is longer than the reply communication limiting interval (step S7), i.e., when the step S7 results in affirmation "YES", the intra-area vehicle-traveled distance arithmetic circuit 15 outputs a reply communication enable signal b to the controller 8A of the vehicle-onboard ETC apparatus by regarding that the motor vehicle has passed through the communication-instable area, as is illustrated in FIG. 5. In this conjunction, it should be mentioned that even after the reply communication enable signal b has been outputted, the intra-area vehicle-traveled distance arithmetic circuit 15 continues to fetch the vehicle speed information from the vehicle speed sensor 17 for thereby determining arithmetically the distance over which the motor vehicle has traveled within the communication area, for thereby deciding whether or not the motor vehicle is still running within the communication area.

On the other hand, the controller 8A of the vehicle-onboard ETC apparatus makes decision as to whether or not the reply communication enable signal b has been inputted. Unless the reply communication enable signal b is inputted, the vehicle-onboard ETC apparatus is set to the state incapable of responding to the ETC communication equipment of the toll gate (steps S10, S11). By contrast, when the reply communication enable signal b has been inputted to the controller 8A of the vehicle-onboard ETC apparatus and when the latter receives the communication signal #1 sent from the ETC communication equipment of the toll gate (step S12), as is illustrated in FIG. 5, the controller 8A of the vehicle-onboard ETC apparatus returns a reply communication signal #2 to the ETC communication equipment of the toll gate (step S13).

Upon sending out of the communication signal #2, the communication for toll charge/payment transaction information is started, whereupon the communication signals are interchanged between the vehicle-onboard ETC apparatus and the ETC communication equipment of the toll gate over a plural number of times (steps S14 to S16).

When a communication signal #N indicating the end of the communication set previously is received as the result of the interchange of the communication signals between the vehicle-onboard ETC apparatus and the ETC communication equipment (step S17), a communication end signal c is outputted to the intra-area vehicle-traveled distance arithmetic circuit 15 (step S18).

Furthermore, in the case where the intra-communication-area vehicle-traveled distance determined arithmetically is decided as exceeding the communication area by the intra-area vehicle-traveled distance arithmetic circuit 15, the relevant arithmetic operation for calculating the intra-communication-area vehicle-traveled distance is terminated (step S19) while the results of the calculation of intra-communication-area vehicle-traveled distance being cleared (step S19*a*), whereupon the intra-area vehicle-traveled distance arithmetic circuit 15 is set to the state ready for performing the traveled distance calculation in a next or succeeding communication area.

As can be understood from the foregoing description, by virtue of such arrangement of the vehicle-onboard ETC apparatus that the communication between the ETC communication equipment installed at the toll gate and the vehicle-onboard ETC apparatus is stopped or interrupted within the communication-instable area such as the areas A and B illustrated in FIG. 2, occurrence of the short inter-vehicle distance running of plural motor vehicles, low-speed traveling and/or the temporary stoppage thereof within the communication-instable area due to the traffic jam or for the other reason does not lead to the communication-disabled state which may otherwise be brought about when the number of times the retrials for establishing the communication path as carried out by the ETC communication equipment exceeds a predetermined value. Thus, when the motor vehicle has passed through the communication-instable area, normal communication for disposing of the ETC charge/payment transaction can be restored with a high reliability.

At this juncture, it should be mentioned that in the case where the controller of the vehicle-onboard ETC apparatus is so designed as to be capable of deciding whether the received data is to be accepted or not on the basis of the field intensity discrimination signal, the logical AND circuit 7 can be spared to an advantage, because the communication signal undergone the demodulation through the data demodulator 4 can be inputted as the received data. Besides, when the controller of the vehicle-onboard ETC apparatus is so designed as to carry out the intra-communication-area vehicle-traveled distance calculation arithmetic on the basis of the vehicle speed information derived from the output of the vehicle speed sensor 17, the intra-area vehicle-traveled distance arithmetic circuit 15 can be spared, to another advantage.

Embodiment 2

In the case of the vehicle-onboard ETC-relevant information communication control apparatus according to the first embodiment of the present invention, the entry into the communication area is recognized when it is decided that the output value of the field intensity detector is higher than the sensitivity level.

Figure 9:
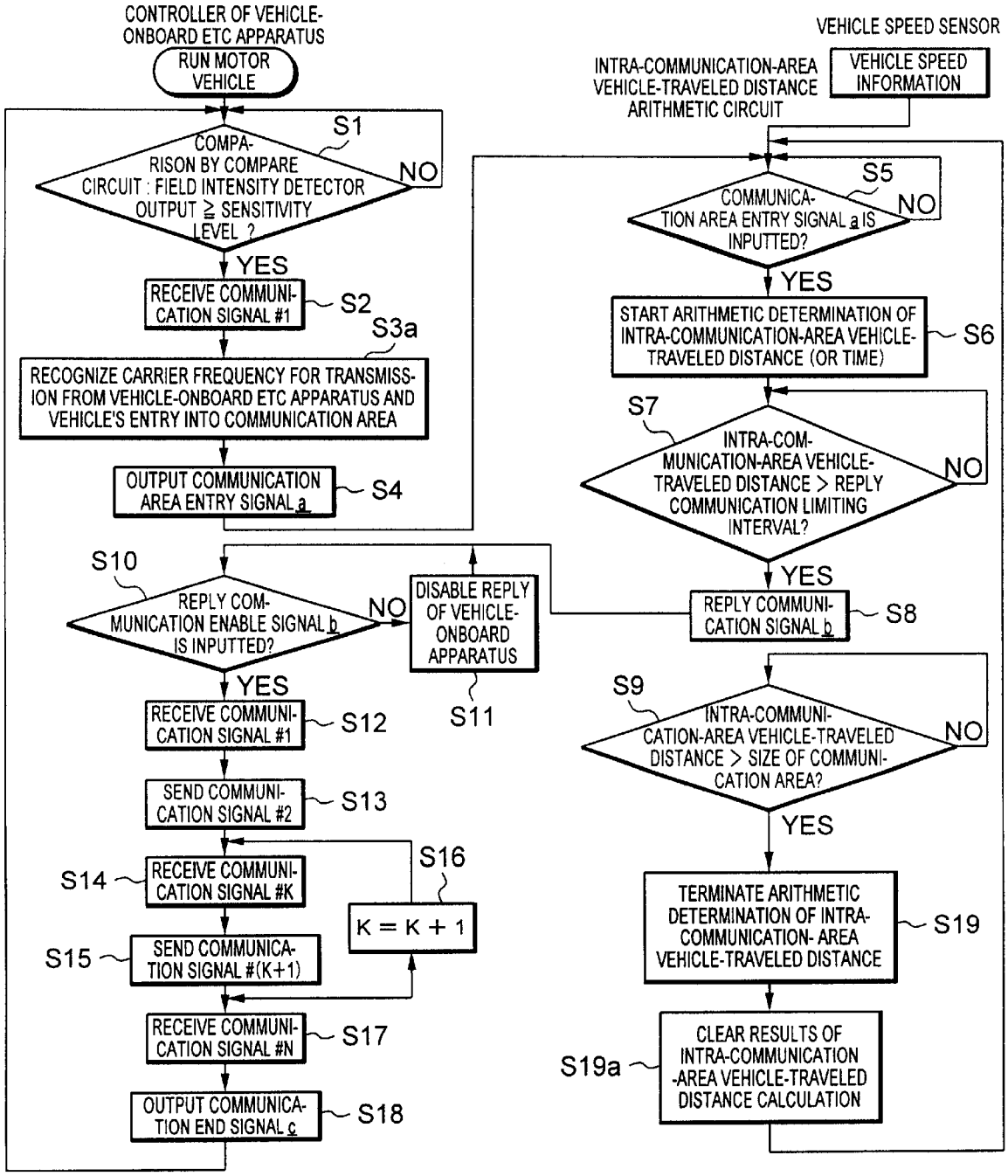
FIG. 9 is a flow chart for illustrating operation of the vehicle-onboard ETC-relevant information communication control apparatus according to the second embodiment of the invention.

On the other hand, the vehicle-onboard ETC-relevant information communication control apparatus according to a second embodiment of the invention is so arranged that upon reception of the communication signal #1 in the step S2, the signal frequency for the transmission is recognized and at the same time the entry into the communication area is recognized in a step S3*a*, as can be seen in the communication sequence of FIG. 5 and the flow chart shown in FIG. 9. When the entry into the communication area is confirmed, the communication area entering signal a is outputted to the intra-area vehicle-traveled distance arithmetic circuit 15 (step S4).

The other operations of the vehicle-onboard ETC-relevant information communication control apparatus according to the second embodiment of the present invention are similar to those of the vehicle-onboard ETC apparatus described hereinbefore in conjunction with the first embodiment.

Embodiment 3

In the case of the vehicle-onboard ETC-relevant information communication control apparatuses according to the first and second embodiments of the present invention, it has been presumed that when the motor vehicle enters the communication area (i.e., prescribed area within which communication between the vehicle-onboard ETC apparatus and the ETC communication equipment of the toll gate is allowed or enabled) at a low speed, the area corresponding to the reply communication limiting interval (i.e., period which extends from the time point the intra-area vehicle-traveled distance arithmetic circuit received the communication area entering signal a to the time point the reply communication enable signal b is outputted) during which the reply communication of the vehicle-onboard ETC apparatus to the ETC communication equipment is limited is set on the basis of the communication-instable area. However, in practice, the automobiles or motor vehicles can usually pass through the communication area at a high speed comparable to the running-speed on the high way without encountering the traffic jam in the vicinity of the communication area. In that case, if the reply communication is started by the vehicle-onboard ETC apparatus only after the lapse of the reply communication limiting interval or after having passed through the corresponding area, there may arise such undesirable situation that the motor vehicle passes through the communication area without establishing a sufficient duration of the communication time period internally of the communication area where the reception field intensity is favorable.

Figure 3:
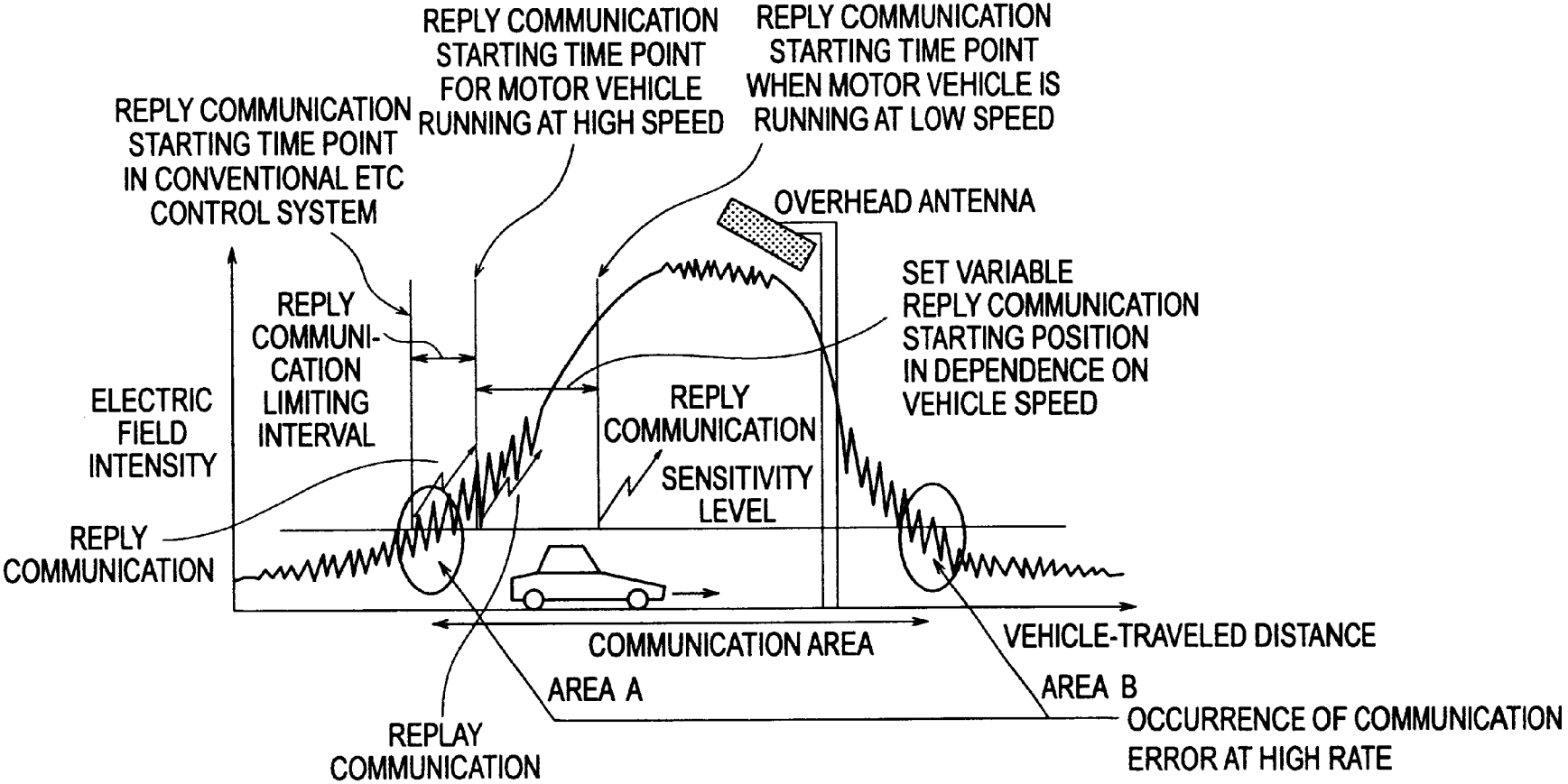
FIG. 3 is a signal reception field intensity distribution diagram for illustrating operations of the vehicle-onboard ETC-relevant information communication control apparatus according to a third embodiment of the present invention.
Figure 6:
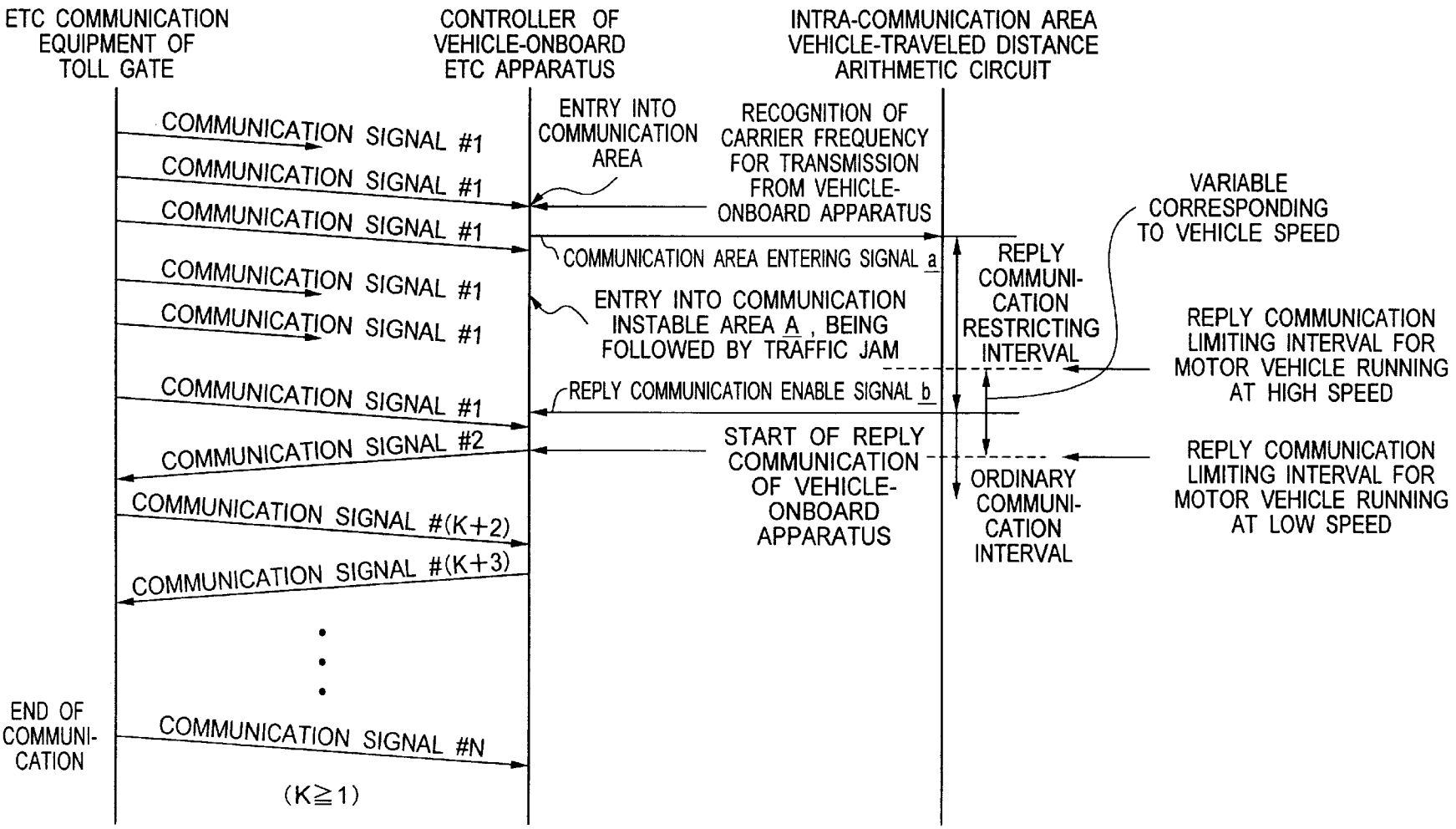
FIG. 6 is a communication sequence chart for illustrating operations of the vehicle-onboard ETC-relevant information communication control apparatus according to the third embodiment of the invention.

In view of the foregoing, it is taught by the present invention incarnated in a third embodiment that when the motor vehicle is running at a high speed, the area corresponding to the reply communication limiting interval is so set as to extend to a location which substantially surpasses the communication-instable area, as is illustrated in the reception field intensity distribution diagram of FIG. 3, wherein after passing through the area corresponding to the reply communication limiting interval (i.e., after lapse of the reply communication limiting interval), the vehicle-onboard apparatus's reply operation is allowed to be started in response to the reply communication enable signal b outputted from the intra-area vehicle-traveled distance arithmetic circuit 15 (refer to FIG. 1), as is illustrated in the communication sequence of FIG. 6.

At this juncture, it should also be mentioned that since the motor vehicle running at a high speed can enter the area or region where the reception field intensity is favorable within a short time after passing through the communication-instable area, it is naturally required to start the reply communication operation of the vehicle-onboard ETC apparatus at an earlier time point. Accordingly, the area corresponding to the reply communication limiting interval or area should preferably be selected to be substantially equal to the communication-instable area in length.

By contrast, when the motor vehicle entering the communication area at a low speed due to traffic jam or for any other reason, the reply communication limiting interval or the corresponding distance is extended up to a location which lies beyond the communication-instable area sufficiently and at which the reception field intensity is favorable in consideration of the possibility of the motor vehicle to park or stop temporarily within or in the vicinity of the communication-instable area. In other words, the reply communication limiting interval or period is set in dependence on the vehicle speed. To say in another word, the reply communication starting position is made variable in dependence on the running speed of the motor vehicle.

Figure 10:
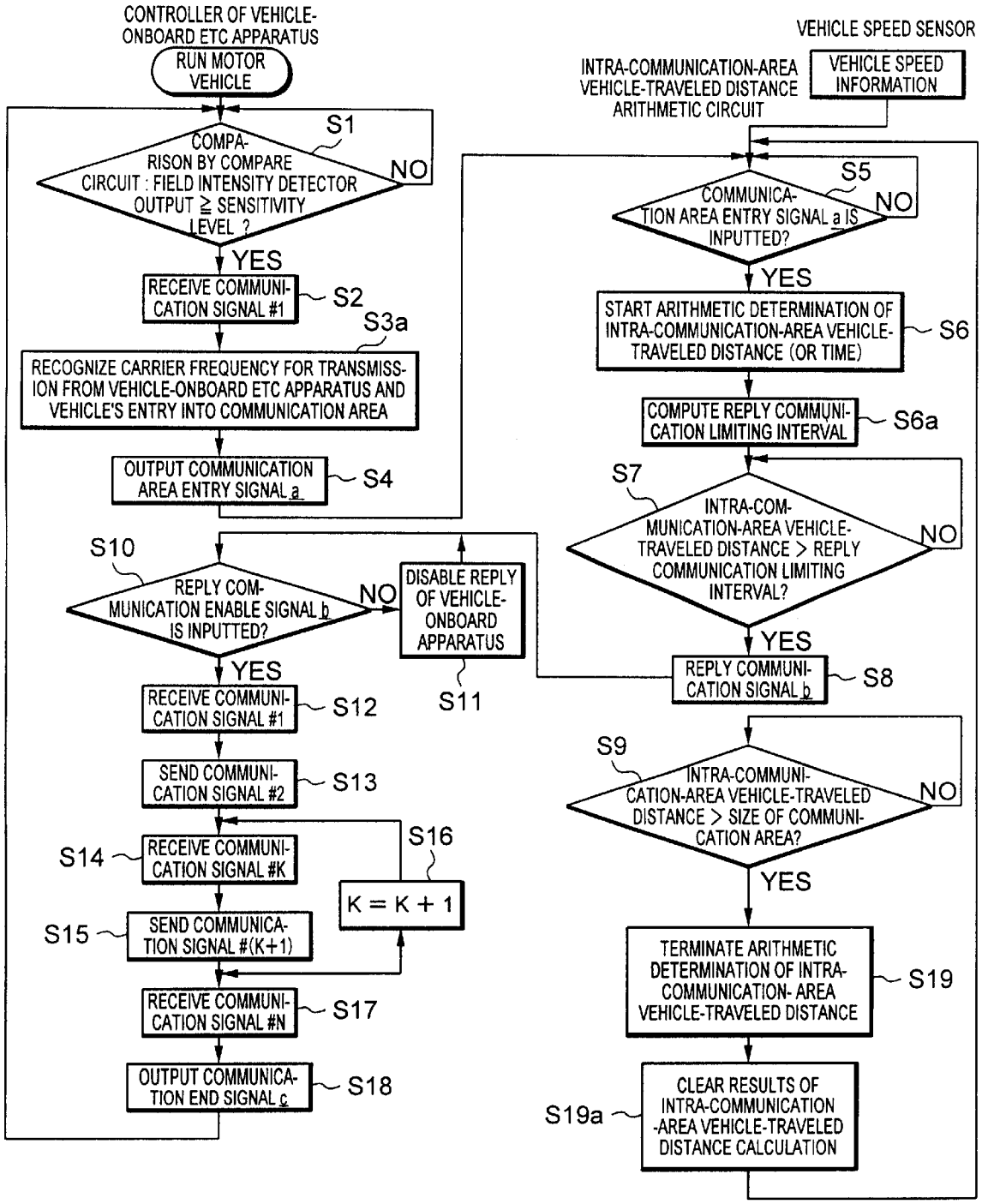
FIG. 10 is a flow chart for illustrating operation of the vehicle-onboard ETC-relevant information communication control apparatus according to the third embodiment of the invention.

Next, referring to the flow chart shown in FIG. 10 as well, description will be directed to the operation of the vehicle-onboard ETC-relevant information communication control apparatus according to the third embodiment of the invention. In the flow chart shown in FIG. 10, the contents of processings executed in the steps designated by same reference characters as those shown in FIG. 9 are essentially same as the processings described hereinbefore by reference to the same figure. Accordingly, in the following description directed to the third embodiment of the invention, emphasis will primarily be put on the processings for arithmetically determining the reply communication limiting interval.

The intra-area vehicle-traveled distance arithmetic circuit 15 fetches the vehicle speed information from the output of the vehicle speed sensor 17 and at the same time makes decision as to whether or not the communication area entering signal a has been inputted (step S5). When it is decided that the communication area entering signal a has been inputted, the intra-area vehicle-traveled distance arithmetic circuit 15 starts computation or calculation of the intra-communication-area vehicle-traveled distance (or running time) defined hereinbefore from the time point when the vehicle speed information and the communication area entering signal a were inputted (step S6).

Subsequently, the reply communication limiting interval is arithmetically determined, i.e., calculated, on the basis of the vehicle speed information (step S6*a*). This reply communication limiting interval or period is short if the speed of the motor vehicle is high as compared with the case when the motor vehicle is running at a low speed, as can be seen in FIG. 3. Here, explanation will be made of the reply communication limiting interval on the basis of the communication sequence illustrated in FIG. 6. When the motor vehicle is running at a high speed, the period (reply communication limiting interval) required for the reply communication enable signal b to be outputted from the intra-area vehicle-traveled distance arithmetic circuit 15 to the controller 8A of the vehicle-onboard ETC apparatus and measured from the time point when the communication area entering signal a was inputted to the intra-area vehicle-traveled distance arithmetic circuit 15 from the controller 8A of the vehicle-onboard ETC apparatus is relatively short when compared with the case where the motor vehicle is running at a low speed.

In a step S7, it is decided whether the intra-communication-area vehicle-traveled distance as calculated is longer or not than the reply communication limiting interval set previously in dependence on the vehicle speed, whereon the intra-area vehicle-traveled distance arithmetic circuit 15 outputs the reply communication enable signal b to the controller 8A of the vehicle-onboard ETC apparatus, as is shown in FIG. 6, when it is decided that intra-communication-area vehicle-traveled distance is equivalently longer than the reply communication limiting interval, by regarding that the motor vehicle has passed through the reply communication limiting interval (step S8). Even after outputting of the reply communication enable signal b, the intra-area vehicle-traveled distance arithmetic circuit 15 continues to fetch the vehicle speed information from the output of the vehicle speed sensor 17 to calculate the vehicle-traveled distance within the communication area for thereby making decision as to whether or not the vehicle-traveled distance exceeds the communication area, i.e., whether or not the motor vehicle has left or departed the communication area (step S9).

As is apparent from the foregoing description, when the vehicle speed is slow, the reply communication limiting interval (reply limiting distance, to say in another way) is extended or elongated, while the reply communication limiting interval (reply limiting distance) is shortened when the vehicle speed is high. In other words, the reply communication limiting interval (reply limiting distance) can controllably be changed in accordance with the vehicle speed. As a result of this, the communication-capable time can adequately be ensured within the communication area even in the case the vehicle speed is high.

Embodiment 4

A fourth embodiment of the present invention is directed to the vehicle-onboard ETC-relevant information communication control apparatus which is so arranged as to perform in addition to the operations of the vehicle-onboard ETC apparatuses described hereinbefore in conjunction with the first to third embodiments those operations for disabling the reply or answer communication of the vehicle-onboard ETC apparatus (vehicle-onboard ETC apparatus's reply or response) to the ETC communication equipment of the toll gate upon completion of the communication for the toll charge/payment processing for thereby enabling ordinary communications to be carried out by releasing the vehicle-onboard ETC apparatus from the reply communication disabled state when it is decided that the motor vehicle has left the currently concerned communication area.

As can easily be appreciated, there may exist a plurality of motor vehicles running within one and the communication area. Accordingly, even when the ETC charge/payment processing communication has been completed between the ETC communication equipment installed at the toll gate and a given one of the vehicle-onboard ETC apparatuses existing within a communication area, the former may send out the communication signal #1 to the vehicle-onboard ETC apparatus than the given one apparatus for conducting the communication for settlement of the toll charge/payment transaction with the other vehicle-onboard ETC apparatus mentioned just above.

In that case, the given vehicle-onboard ETC apparatus having completed the communication described hereinbefore may also send a reply communication signal #2 to the ETC communication equipment of the toll gate in addition to or in place of the other vehicle-onboard, if the vehicle-onboard ETC apparatus is incapable of recognizing that the communication signal #1 mentioned just above has been sent from the ETC communication equipment with which the ETC charge/payment processing communication has been completed.

In order that both the ETC communication equipment of the toll gate and the vehicle-onboard ETC apparatus can recognize that the communication for the ETC charge/payment transaction processing has been completed, the communication has to be carried out several times, which in turn means that when the motor vehicle has passed through the communication area before completion of communication between the vehicle-onboard ETC apparatus of that motor vehicle and the ETC communication equipment of the toll gate has been recognized, the controller 8A of the vehicle-onboard ETC apparatus of the motor vehicle passed through the communication area is set to the state for awaiting the prescribed signal sent from the ETC communication equipment of the toll gate.

As a consequence, in the case where a plurality of toll gates each provided with ETC communication equipment are installed along a same road or lane, there may arise such situation in which the motor vehicle whose vehicle-onboard ETC apparatus is in the state for waiting for the prescribed signal from the ETC communication equipment installed at the preceding toll gate with which the ETC charge/payment processing has already been completed may enter a next communication area of a succeeding toll gate in the above-mentioned state.

If the situation described above takes place, the vehicle-onboard ETC apparatus mentioned above can no more accept the signal for enabling the start of communication with the ETC communication equipment of the succeeding toll gate because the vehicle-onboard ETC apparatus continues to be in the state waiting for reception of the signal from the ETC communication equipment of the preceding toll gate, whereby the ETC charge/payment information processing with the ETC communication equipment of the succeeding toll gate station will be prevented from proceeding any further.

In order to cope with the undesirable situation described above, the vehicle-onboard ETC-relevant information communication control apparatus according to the fourth embodiment of the present invention is so arranged that once the communication between the vehicle-onboard ETC apparatus of a motor vehicle and an ETC communication equipment of a given toll gate has been completed within a communication area thereof, any further communication for reply from the vehicle-onboard ETC apparatus is inhibited until the motor vehicle leaves that communication area.

In the following, operation of the vehicle-onboard ETC-relevant information communication control apparatus according to the instant embodiment of the invention will be described by putting emphasis on the processing for disabling the reply communication of the vehicle-onboard ETC apparatus and the processing for releasing the vehicle-onboard ETC apparatus from the reply communication disabled state by referring to the reception field intensity distribution diagram shown in FIG. 4, the communication sequence chart illustrated in FIG. 7 and the flow chart shown in FIG. 11.

Figure 4:
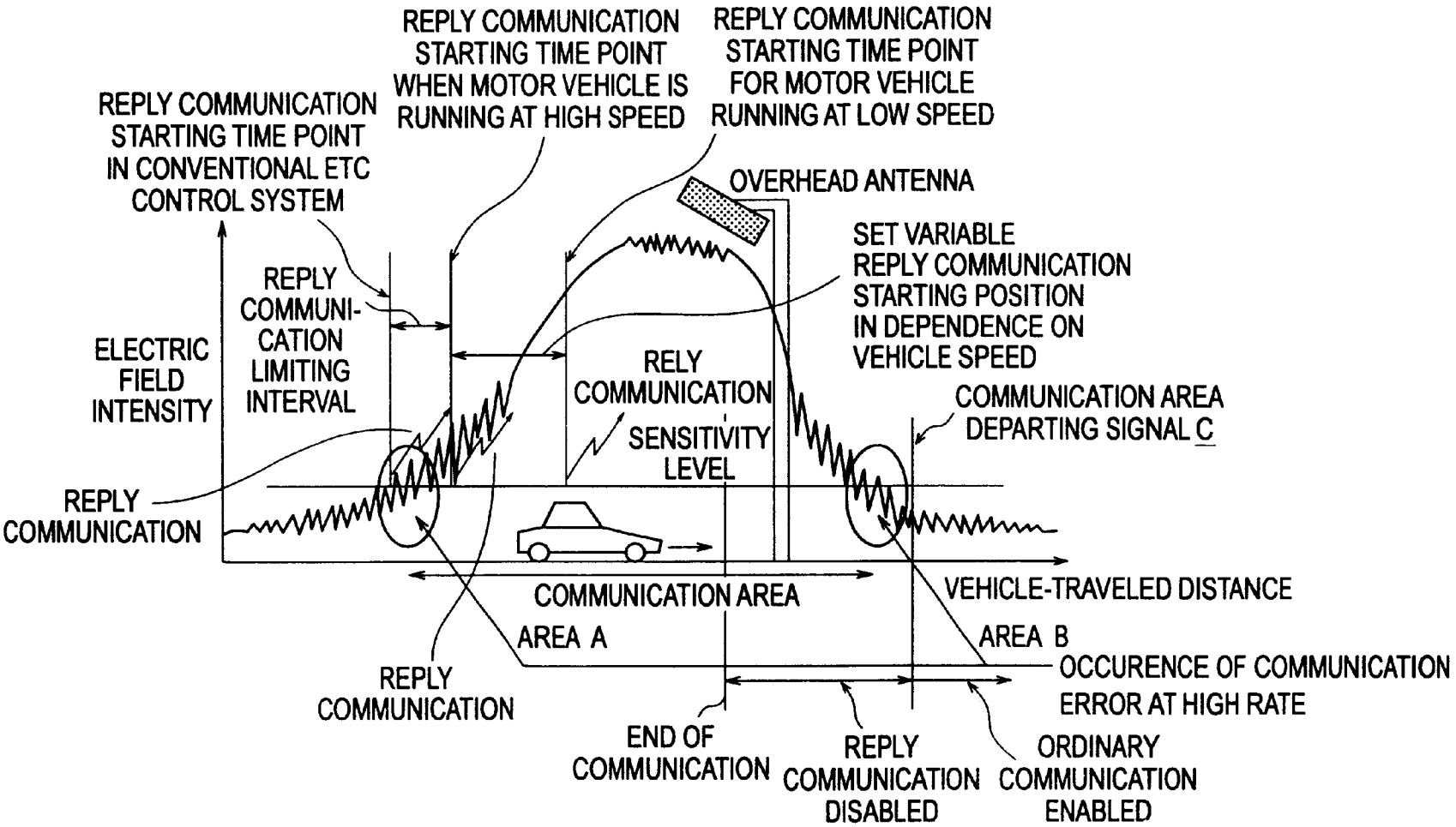
FIG. 4 is a signal reception field intensity distribution diagram for illustrating operations of the vehicle-onboard ETC-relevant information communication control apparatus according to a fourth embodiment of the present invention.
Figure 7:
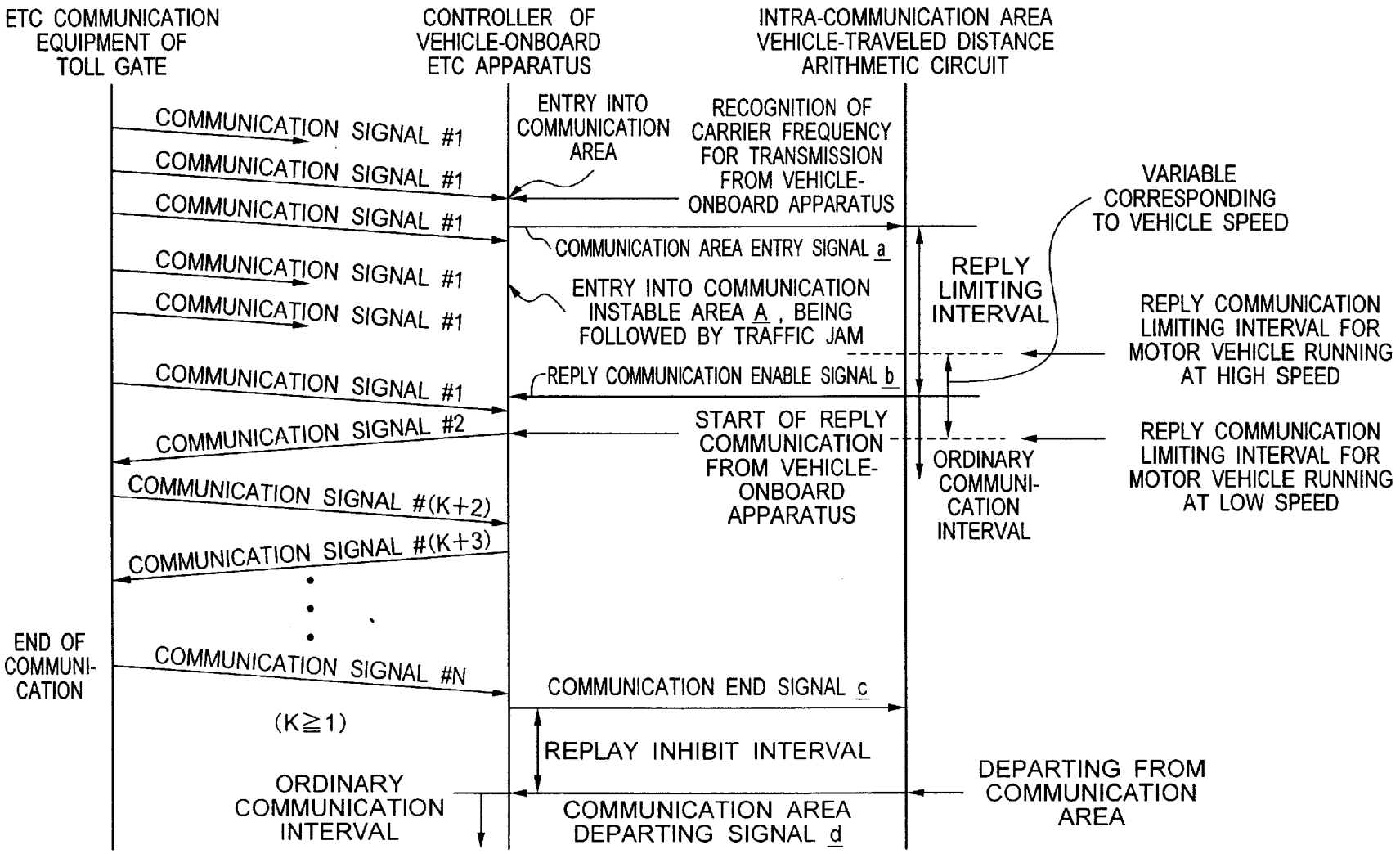
FIG. 7 is a communication sequence chart for illustrating operations of the vehicle-onboard ETC-relevant information communication control apparatus according to the fourth embodiment of the invention.

Referring to FIGS. 4 and 7, it is assumed that the controller 8A of the vehicle-onboard ETC apparatus receives a communication signal #N indicative of an end of the communication from the ETC communication equipment of the toll gate when the motor vehicle is traveling within the relevant communication area while conducting communication with the ETC communication equipment of the toll gate, starting from the reply communication starting position. Then, the communication end signal c is supplied to the intra-area vehicle-traveled distance arithmetic circuit 15 from the controller 8A of the vehicle-onboard ETC apparatus. Subsequently, the controller 8A of the vehicle-onboard ETC apparatus is disabled or inhibited from continuing the reply communication to the ETC communication equipment until the controller 8A of the vehicle-onboard ETC apparatus receives the communication area departing signal d from the intra-area vehicle-traveled distance arithmetic circuit 15. In response to the input of the communication area departing signal d supplied from the intra-area vehicle-traveled distance arithmetic circuit 15, the controller 8A of the vehicle-onboard ETC apparatus resets or clears the vehicle-onboard apparatus's reply communication inhibit command to thereby allow the ordinary communication to be performed.

Next, referring to the flow chart shown in FIG. 11, the reply communication enable signal b is outputted in a step S8. In succession, the intra-area vehicle-traveled distance arithmetic circuit 15 makes decision on the basis of the vehicle speed information as to whether or not the intra-communication-area vehicle-traveled distance exceeds the size or length of the communication area (step S9). When it is decided that the intra-communication-area vehicle-traveled distance is longer than the communication area (i.e., when the decision step S9 results in affirmation "YES"), the arithmetic operation or calculation for determining the intra-communication-area vehicle-traveled distance is terminated, whereupon the communication area departing signal d is outputted (step S21). After outputting of the communication area departing signal d, the intra-area vehicle-traveled distance arithmetic circuit 15 clears the results of calculation of the relevant intra-communication-area vehicle-traveled distance (step S19*a*), making preparation ready for performing arithmetic operation on the received data in a succeeding ETC charge/payment settling communication process.

On the other hand, the controller 8A of the vehicle-onboard ETC apparatus receives a communication signal #N indicative of the end of the communication from the ETC communication equipment of the toll gate after plural (k) times of signal interchanges, as is illustrated in the communication sequence chart shown in FIG. 7. Then, the controller 8A of the vehicle-onboard ETC apparatus supplies the communication end signal c to the intra-area vehicle-traveled distance arithmetic circuit 15 in a step S18. Upon reception of the communication end signal c, the intra-area vehicle-traveled distance arithmetic circuit 15 clears the results of calculation of the relevant intra-communication area running distance (step S19*a*), making preparation to be ready for arithmetic operation on the vehicle-traveled distance in a succeeding communication area.

After outputting of the communication end signal c, the controller 8A of the vehicle-onboard ETC apparatus executes a command for disabling or inhibiting the reply communication to the ETC communication equipment in a step S20. In the course of running in the communication area while executing the command mentioned above, the controller 8A of the vehicle-onboard ETC apparatus makes decision as to whether or not the communication area departing signal d is inputted. When it is decided that the communication area departing signal d is inputted in a step S22, the controller 8A of the vehicle-onboard ETC apparatus resets or invalidates the vehicle-onboard apparatus's reply communication inhibit command to thereby allow the ordinary communication function to be restored in steps S23 and S24.

As can now be appreciated from the foregoing description, by virtue of the arrangement of the vehicle-onboard ETC-relevant information communication control apparatus according to the fourth embodiment of the invention, the communication data as well as the reply communication wait-for signal which would otherwise remain even after the communication with the preceding toll gate ETC communication equipment can positively be prevented from being sustained valid up to a communication area of a succeeding communication area, whereby the problem of the communication disturbance from which the succeeding toll gate ETC communication facility may otherwise suffer due to the communication data and the reply communication wait-for signal which continue to exist from the preceding toll gate ETC communication equipment can be solved satisfactorily.

Many features and advantages of the present invention are apparent from the detailed description and thus it is intended by the appended claims to cover all such features and advantages of the apparatus which fall within the true spirit and scope of the invention. Further, since numerous modifications and combinations will readily occur to those skilled in the art, it is not intended to limit the invention to the exact construction and operation illustrated and described.

By way of example, the controller 8A may be implemented by using a microcomputer or a microprocessor programmed correspondingly. Besides, the intra-communication-area vehicle-traveled distance arithmetic circuit 15 may be realized by a microcomputer or a microprocessor programmed correspondingly. Moreover, both the controller 8A of the vehicle-onboard ETC apparatus and the intra-area vehicle-traveled distance arithmetic circuit 15 may also be integrated in a single unit. Furthermore, communication processing procedures illustrated in the various flow charts may be realized in terms of programs which can be executed by the microcomputer (8A; 15). In that case, it is intended that the microcomputer chip incorporating the programs as well as a recording medium storing them is to fall within the purview of the present invention.

Accordingly, all suitable modifications and equivalents may be resorted to, falling within the spirit and scope of the invention.

What is claimed is:

1. An vehicle-onboard ETC-relevant information communication control apparatus mounted on a motor vehicle capable of running on and along a toll road for interchanging information required for toll charge/payment transaction with ETC communication equipment installed in association with said toll road to thereby execute toll charge/payment settlement processing on the basis of said ETC-relevant information;

said vehicle-onboard ETC-relevant information communication control apparatus comprising:

communication limiting interval setting means for setting a communication limiting interval for disabling function of said vehicle-onboard ETC-relevant information communication control apparatus to conduct communication with said ETC communication equipment until said motor vehicle entered a communication area where communication between said vehicle-onboard ETC-relevant information communication control apparatus and said ETC communication equipment is allowed has traveled for a predetermined distance within said communication area after entry thereto;

vehicle-traveled distance arithmetic means for arithmetically determining a vehicle-traveled distance for which said motor vehicle has traveled within said communication area from a time point when said motor vehicle entered said communication area; and communication control means for making decision as to whether or not said vehicle-traveled distance arithmetically determined by said vehicle-traveled distance arithmetic means exceeds said communication limiting interval preset by said communication limiting interval setting means, to thereby allow communication between said vehicle-onboard ETC-relevant information communication control apparatus and said ETC communication equipment to be started when said decision is made to such effect that said vehicle-traveled distance has exceeded said communication limiting interval.

2. An vehicle-onboard ETC-relevant information communication control apparatus according to claim 1, wherein said communication limiting interval setting means is so designed as to set a communication limiting interval for disabling communication between said vehicle-onboard ETC-relevant information communication control apparatus and said ETC communication equipment, said interval extending from termination of the communication concerning the toll charge/payment transaction between said ETC communication equipment and said vehicle-onboard ETC-relevant information communication control apparatus to a time point at which any signal can no more be received from said ETC communication equipment for which the communication with said vehicle-onboard ETC-relevant information communication control apparatus has been terminated within the relevant communication area.

3. An vehicle-onboard ETC-relevant information communication control apparatus according to claim 1, wherein said communication limiting interval setting means is further so designed as to set said communication limiting interval relatively short when running speed of said motor vehicle is relatively high, while setting said communication limiting interval relatively long when the running speed of said motor vehicle is relatively low.

4. An vehicle-onboard ETC-relevant information communication control apparatus according to claim 3, wherein said communication limiting interval setting means is so designed as to set a communication limiting interval for disabling communication between said vehicle-onboard ETC-relevant information communication control apparatus and said ETC communication equipment, said interval extending from termination of the communication concerning the toll charge/payment transaction between said ETC communication equipment and said vehicle-onboard ETC-relevant information communication control apparatus to a time point at which any signal can no more be received from said ETC communication equipment for which the communication with said vehicle-onboard ETC-relevant information communication control apparatus has been terminated within the relevant communication area.

5. An vehicle-onboard ETC-relevant information communication control apparatus according to claim 3, wherein said communication limiting interval setting means is so designed as to set said communication limiting interval by extending in dependence on a traveling speed of the motor vehicle a time point lapsing from a time period when said motor vehicle entered said communication area to a time point at which said ETC-relevant information communication is to be started.

* * * * *